US008397934B2

(12) United States Patent
Lai

(10) Patent No.: US 8,397,934 B2
(45) Date of Patent: Mar. 19, 2013

(54) PADLOCK CONTAINER ASSEMBLY HAVING A LOCKING CLOSURE WITH SLIDING COVER

(76) Inventor: Ying-Tsung Lai, Taichung (TW)

( * ) Notice: Subject to any disclaimer, the term of this patent is extended or adjusted under 35 U.S.C. 154(b) by 113 days.

(21) Appl. No.: 13/064,769

(22) Filed: Apr. 14, 2011

(65) Prior Publication Data

US 2012/0067889 A1 Mar. 22, 2012

(30) Foreign Application Priority Data

Sep. 17, 2010 (TW) ..... 99218113 U

(51) Int. Cl.
*B65D 51/18* (2006.01)
*B65D 45/16* (2006.01)
*B65D 43/12* (2006.01)

(52) U.S. Cl. ..... 220/254.9; 220/259.5; 220/324; 220/345.1

(58) Field of Classification Search ..... 220/254.1, 220/254.9, 256.1, 259.5, 324, 345.1, 345.2
See application file for complete search history.

(56) References Cited

U.S. PATENT DOCUMENTS

| | | | | |
|---|---|---|---|---|
| 4,375,850 | A * | 3/1983 | Smyth et al. | 206/387.15 |
| 4,619,364 | A * | 10/1986 | Czopor, Jr. | 206/379 |
| 4,632,242 | A * | 12/1986 | Choi et al. | 206/45.24 |
| 4,739,883 | A * | 4/1988 | Mohs et al. | 206/470 |
| 5,190,200 | A * | 3/1993 | Hammerlund | 225/42 |
| D355,598 | S * | 2/1995 | Aronhalt | D9/415 |
| 5,509,528 | A * | 4/1996 | Weisburn | 206/45.24 |
| 6,283,311 | B1 * | 9/2001 | Lee | 211/70.6 |
| 6,409,015 | B1 * | 6/2002 | Hu | 206/378 |
| D505,068 | S * | 5/2005 | Cunningham et al. | D9/415 |
| 7,195,120 | B2 * | 3/2007 | Cunningham et al. | 206/461 |
| 7,735,678 | B2 * | 6/2010 | Rushe et al. | 220/837 |
| 2004/0217032 | A1 * | 11/2004 | Cunningham et al. | 206/461 |

* cited by examiner

*Primary Examiner* — J. Gregory Pickett
*Assistant Examiner* — Ned A Walker

(57) ABSTRACT

A padlock container assembly for packing and maintaining small articles is assembled primarily from a box container and a closure for closing the open top of the container. Buckle holes are disposed in the upper sidewall of the container that cooperate with elastic closure pieces disposed on a skirt of the closure to lock the closure the container. The closure has a sliding cover capable of being moved according to a predetermined path disposed on an external cover of the closure. A series of holes in the closure allows for various connection arrangements between closure parts. A hangtag extends upwardly from the external cover to allow the container assembly to be hanging and exhibiting.

6 Claims, 9 Drawing Sheets

PADLOCK CONTAINER ASSEMBLY HAVING A LOCKING CLOSURE WITH SLIDING COVER

FIELD OF THE INVENTION

The present invention relates to a padlock container structure. The foregoing container is provided for packing and containing small articles or taken as a utensil for storing box body. The foregoing small articles are different types of articles that are filled in the container through a predetermined shaped hole on an external cover of the container or taken out of the container through the shaped hole.

BACKGROUND OF THE INVENTION

According to a prior art, which is related to a present application, U.S. Pat. No. 7,195,120 entitled "Tool bit storage and display container", the patent disclosed a container for containing tool and having an upward opening. The container is provided with a hexagon hole, which penetrates through thereof, at its rear wall and has an external cover connected to its opening end. A rectangular opening is disposed at a top of the external cover. A protrusion portion is extended from a front end of the rectangular opening, and a hinge type upper cover capable of being repeatedly lifted and covering is integrated with a rear end of the rectangular opening. The upper cover can completely cover the rectangular opening, and a protruding buckle is disposed in front of a bottom of the upper cover. After the upper cover covers the rectangular opening, the protruding buckle is utilized to be fastened at a bottom of a protrusion portion of the rectangular opening to show a locking state.

In addition, the external cover has a burglarproof cover plate, which covers a major portion of areas of the rectangular opening, connected to an edge of the bottom of the rectangular opening. The manner of connecting the burglarproof cover plate and the rectangular opening is that proper spaces and distances are spaced and predetermined at the front end and the rear end of the burglarproof cover plate respectively connected to the protrusion portion and the upper cover. Its purpose is that the protruding buckle of the upper cover can be accommodated inside the upper cover through the space. Two sides of the burglarproof cover plate are merely preset with partial edges to connect the edge of the bottom of the rectangular opening. Accordingly, a buyer only imposes downward forces on the burglarproof cover plate to crack the connection relationship between the burglarproof cover plate and the rectangular opening such the burglarproof cover plate can be quickly torn and taken out to allow the rectangular opening showing an opening state without covering. Tools or articles contained in the container can be easily taken out of the rectangular opening.

Moreover, the prior art further comprises a hangtag. A hanging hole is disposed to an upper end of the hangtag. Symmetric cantilever hooks having barbs, which protrude toward a front direction, are disposed at a lower position of the hangtag. Accordingly, after the prior art utilizes a front end surface of the hangtag to paste a rear end wall of the container, the symmetric cantilever hooks are inserted into the hexagon hole of the container, and the connection and positioning functions can be achieved through the barbs of the cantilever hooks fastened to an end surface of the rear end wall of the container. An upper surface and a lower surface at two cantilevers of the symmetric cantilever hooks are designed as parallel surfaces. The two parallel surfaces respectively lean against any one symmetric parallel surface of the hexagon hole to show the positioning state so that the hangtag is prevented from being randomly rotated after connecting the container.

The forgoing structure of the prior art has defects that include:

1. The upper cover disposed to the external cover can be randomly opened during the exhibition and sale. The burglarproof cover plate hidden inside the rectangular opening can also be easily torn and cracked to take out tools for sale or articles contained in the container. In addition, the appearance of the external cover may not be seen even if the hidden burglarproof cover plate is torn and cracked.
2. A protruding buckle of the upper cover is fastened to a bottom of the protrusion portion extended from the rectangular opening. However, the protruding buckle designed as barbs is usually difficult to be opened although it is easily opened. After the upper cover is covered, the barbs of the protruding buckle may not easily come off the suppressing of the bottom of the protrusion portion by upwardly pushing the upper cover.
3. Although the hexagon hole designed at the rear of the container provides a function of buckling and positioning the symmetric cantilever hooks of the hangtag, intervals are predetermined between the symmetric cantilever hooks to properly compress and shift the two cantilever hooks. Therefore, once the container and the hangtag are reversely rotated, the relative position between the hangtag and the container can be changed. Consequently, the hangtag may not be accurately assembled and positioned.

SUMMARY OF THE INVENTION

A primary objective of the present invention is to provide a padlock container structure having hanging function or locking function during the exhibition to prevent contained articles from being stolen.

To achieve the foregoing objective, the padlock container structure provided by the invention comprises a container box, a sliding cover and a hangtag. The container box has one opening end that is fit an external cover capable of being detached and assembled. The external cover has a platform disposed thereon. The platform is provided with a central through hole at a central position of the platform. A shaped hole is disposed at a side of the central through hole. Symmetric long sliding channels are disposed to a front side and a rear side of the central through hole of the platform. The sliding cover is capable of covering the platform of the external cover. One end of the sliding cover completely covers the shaped hole of the external cover while another end of the sliding cover has a vertical via hole aligning the central through hole. Symmetric convex wings are disposed to corresponding sides of the sliding cover to respectively fit in the symmetric long sliding channels, thereby performing shifting and regulating. The hangtag has a hang hole predetermined at an upper end of the hangtag. A rod body is disposed to a lower end of the hangtag passing through the vertical via hole of the sliding cover and the central through hole of the external cover so as to lock the sliding cover and the external cover. Symmetric flexible hangers are disposed to an end of the rod body to be stopped at an external periphery of a bottom of the central through hole.

When the vertical via hole of the sliding cover aligns the central through hole of the platform of the external cover, one end of the sliding cover can cover up the shaped hole of the external cover. In the meantime, the rod body can be vertically cascaded between the vertical via hole of the sliding cover and the central through hole of the external cover through the symmetric flexible hangers, and hanging portions of the symmetric flexible hangers baffle a bottom of the central through hole so that the symmetric flexible hangers are unable to eject from the central through hole to allow the combination of the external cover and the sliding cover to temporarily have locking function, thereby effectively preventing the sliding cover from being pushed.

Moreover, the container box of the invention is made of a transparent material. Accordingly, the containing articles which are for sale can be clearly seen by consumers from outside.

Further, after the rod body of the hangtag is cascaded to the vertical via hole of the sliding cover and the central through hole of the external cover, the hangtag shown in the embodiment is designed as a rectangular plate body to prevent the hangtag from being randomly rotated. A protrusion portion is disposed at a side of the vertical via hole of the sliding cover. The protrusion portion is located at an area under the hangtag, and the protrusion portion has a slot which is vertically disposed under the hangtag. The slot is provided for correspondingly containing a bottom of the hangtag. Accordingly, the hangtag can be prevented from being randomly rotated.

In addition, more than one long elastic piece is disposed on the platform of the external cover. The long elastic piece in the embodiment is integrated with the platform. A trench piercing through the platform is disposed along three ends of the long elastic piece. Only one short end of the long elastic piece is connected to the platform. Accordingly, the long elastic piece has functions of vertically moving and automatically restoring. Further, the long elastic piece has a circular protrusion portion near the short end of the trench. The circular protrusion portion is disposed at an end of the long elastic piece. The sliding cover has more than one set of first circular cavities and second circular cavities at two sides of the vertical via hole to contain and limit the circular protrusion portion. A set number of the first circular cavities and the second circular cavities correspond to a number of the long elastic piece disposed on the platform. In the embodiment, after one end of the sliding cover completely covers the shaped hole of the external cover, one set of the first circular cavities disposed to the sliding cover is exactly provided for containing and limiting the circular protrusion portion of a long elastic piece. After the sliding cover is pushed to allow one end of the sliding cover to completely eject from the shaped hole of the external cover, one set of the second circular cavities disposed to the sliding cover is exactly provided for containing and limiting the circular protrusion portion of a long elastic piece.

DETAILED DESCRIPTION OF THE PREFERRED EMBODIMENTS

Figure 1:
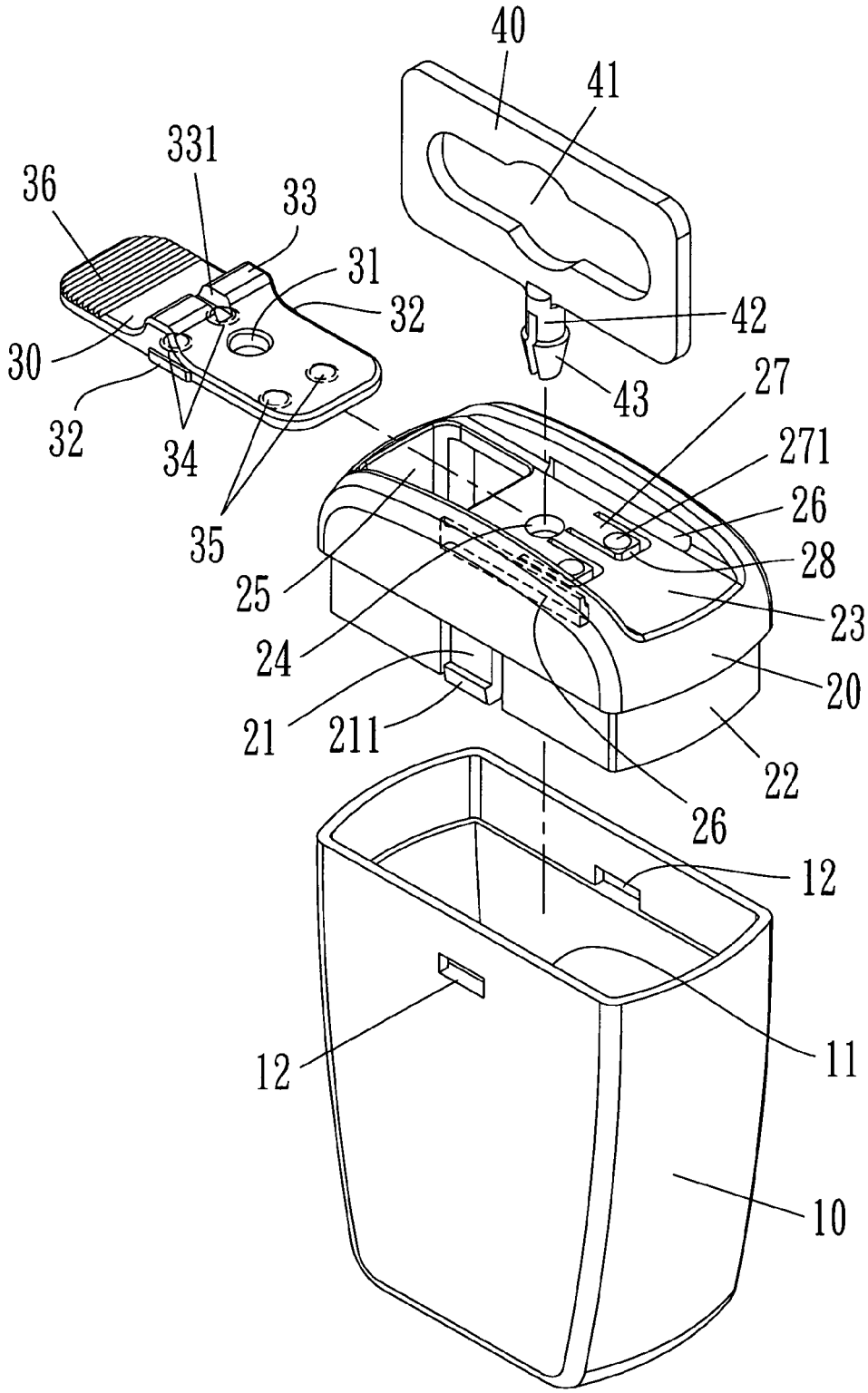
FIG. 1 is a decomposition drawing of a structure according to a preferred embodiment of the present invention.
Figure 2:
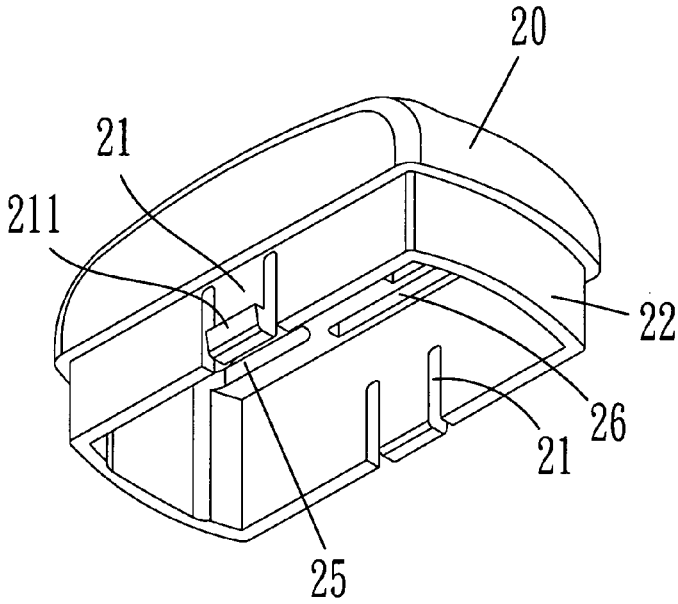
FIG. 2 is a bottom view drawing of an external case of a structure according to a preferred embodiment of the present invention.

Other features and advantages of the present invention will become apparent from the following description of the invention which refers to the accompanying drawings.

Referring FIG. 1 to FIG. 10 for a padlock container structure in accordance with a preferred embodiment of the invention is depicted. The structure comprises a container box 10, an external cover 20, a sliding cover 30 and a hang tag 40. The container 10 utilized in the preferred embodiment is made of a transmittance material and a transparent plastic container box. Accordingly, articles inside the container box can be clearly seen from the outside. The structure of the container box 10 is slightly a rectangular box body, wherein its opening end 11 is disposed to an upper end of the rectangular box body, and symmetric buckle holes 12 are disposed at corresponding ends near the opening end 11 to provide fitting the external cover 20.

The external cover 20 covers the opening end of the container box 10, wherein symmetric elastic pieces 21 are disposed at two sides of a bottom of the external cover 20. A convex stop 211 is respectively disposed to corresponding exteriors of the two elastic pieces 21 and can fit the symmetric buckle hole 12 of the container box 10 to firmly connect the external cover 20 and the container box 10. When a user would like to open the external cover 20, he/she must simultaneously press the convex stops 211 of the symmetric elastic pieces 21 to allow the two convex stops 211 to simultaneously eject from the symmetric buckle holes 12 of the container box 10 so that the external cover 20 can come off the container box 10. In the embodiment, a fitting section 22 is downwardly extended from external frame edge of a bottom of the external cover 20. A size of the external frame of the fitting section 22 is slightly smaller than a size of the external frame of the external cover 20, and the fitting section 22 can be completely contained inside the opening end 11 of the container box 10 to provide better sealing effect between the container box 10 and the external cover 20. In addition, it should be noted that the symmetric elastic pieces 21 are disposed to front and rear surfaces of the fitting section 22.

A platform 20 is disposed to an upper end of the external cover 20. A central through hole 24 is disposed to a central position of the platform 23. A shaped hole is disposed at a side of the central through hole 24 of the platform 23. The shaped hole 25 is designed as a rectangular hole in the embodiment and provided for filling or pouring articles or tools. Moreover, symmetrically long sliding channels 26 are disposed to a front corresponding side and a rear corresponding side of the central through hole 24 of the platform 23.

The sliding cover 30 can cover an upper end surface of the platform 23 of the external cover 20, wherein one end of the sliding cover 30 can completely cover the shaped hole 25 of the external cover 20 while another end of the sliding cover 30 has a vertical via hole 31 for aligning the central through hole 24 of the external cover 20. Symmetric convex wings 32 are disposed to a front corresponding side and a rear corresponding side of the sliding cover 30 and can fit the symmetrically long sliding channels 26 of the external cover 20 to properly shift and regulate along the path direction.

A hang hole 41 is predetermined at an upper end of the hangtag 40. A rod body 42 is disposed at a lower end of the hangtag 40. The rod body 42 can fit between the vertical via hole 31 of the sliding cover 30 and the central through hole 24 of the external cover 20 to lock the external cover 20 and the sliding cover 30. Further, a flexible hanger 43 is disposed at an end of the rod body 42 and can be stopped at an external periphery of a bottom of the central through hole 24. Accordingly, the rod body 42 can be prevented from being ejected from the central through hole 24 and has locking function to achieve the function of preventing parts of the structure from being randomly detached on sale.

The padlock container structure assembled by the foregoing components can mainly utilize the rod body 42 of the hangtag 40 to temporarily string the sliding cover 30 and the external cover 20 to allow the sliding cover 30 to be at an immobile state. Accordingly, the shaped hole 25 of the external cover 20 can be retained at the sealed state to effectively prevent it from being randomly opened during the exhibiting.

Figure 5:
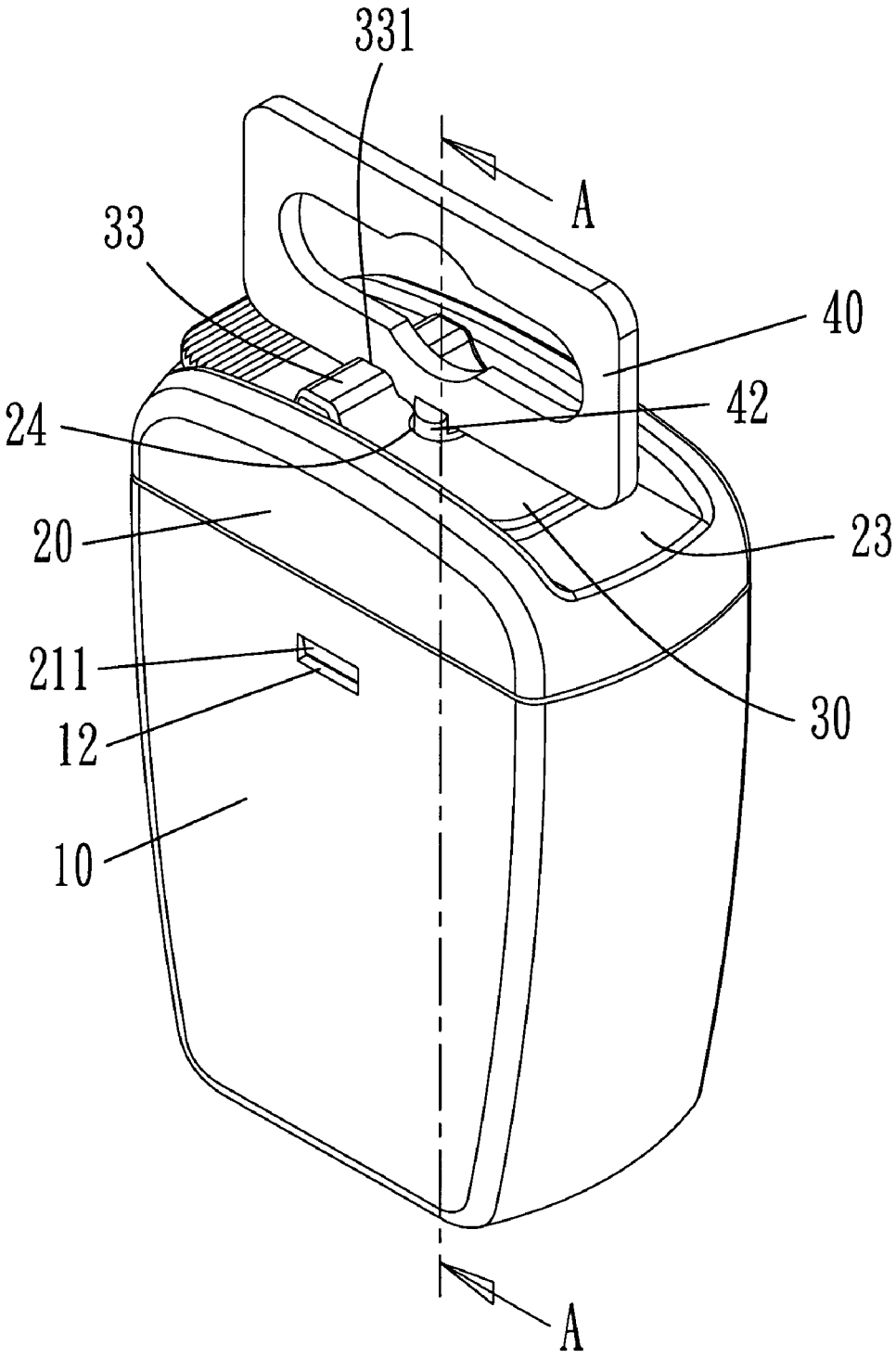
FIG. 5 is a three-dimensional assembly drawing of a structure according to a preferred embodiment of the present invention.
Figure 6:
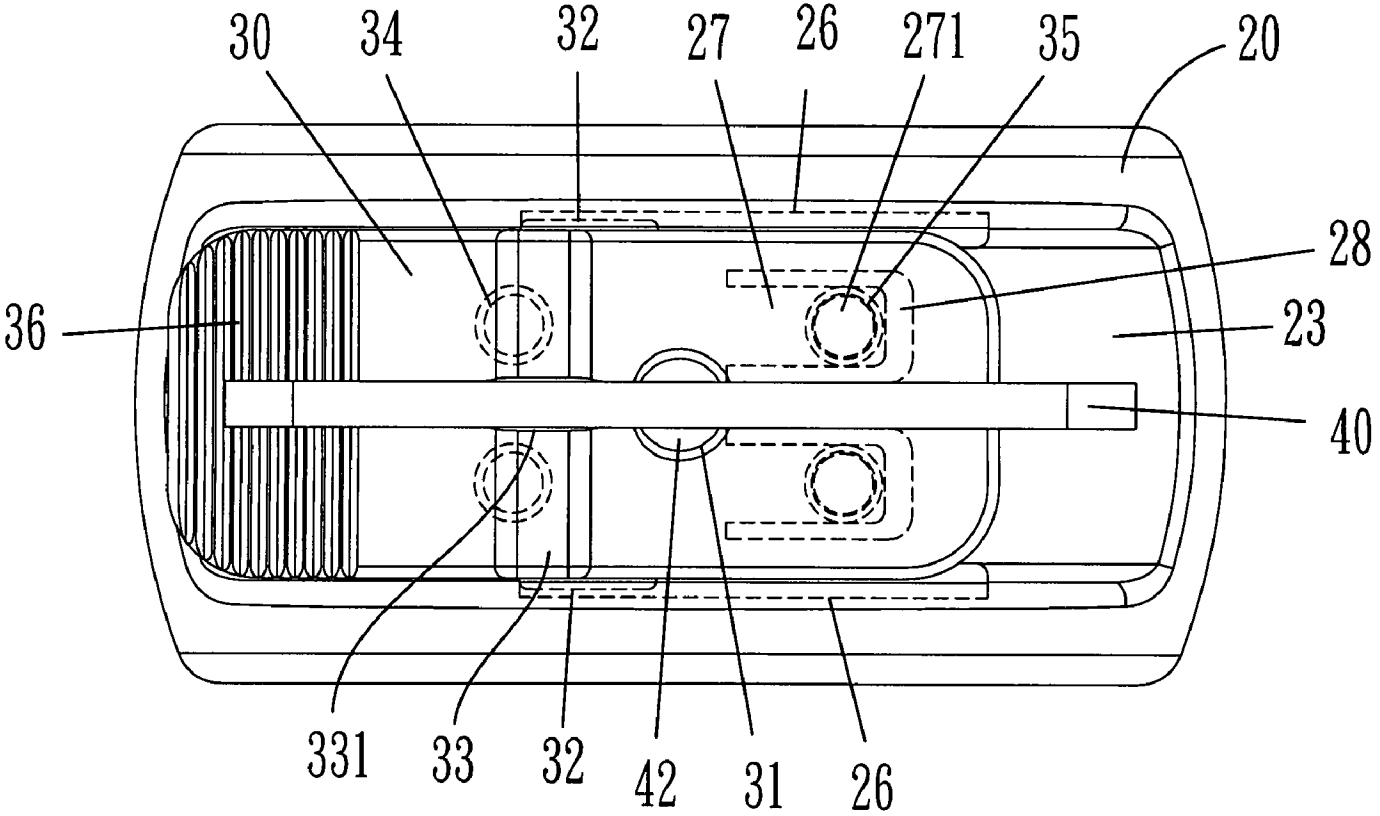
FIG. 6 is an assembly top view drawing of a structure according to a preferred embodiment of the present invention.
Figure 7:
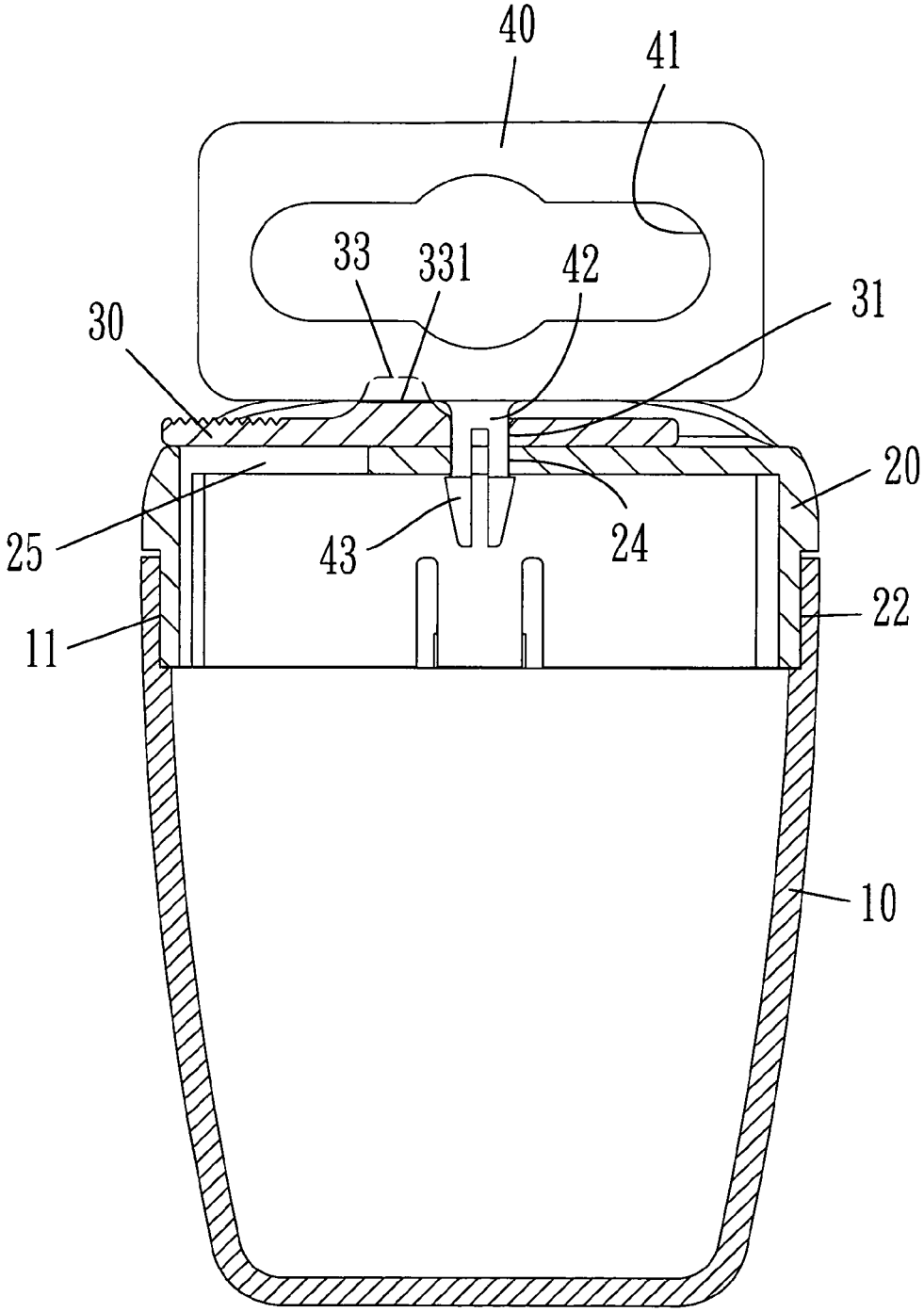
FIG. 7 is an assembly cross-sectional drawing of a front view of a structure according to a preferred embodiment of the present invention.
Figure 8:
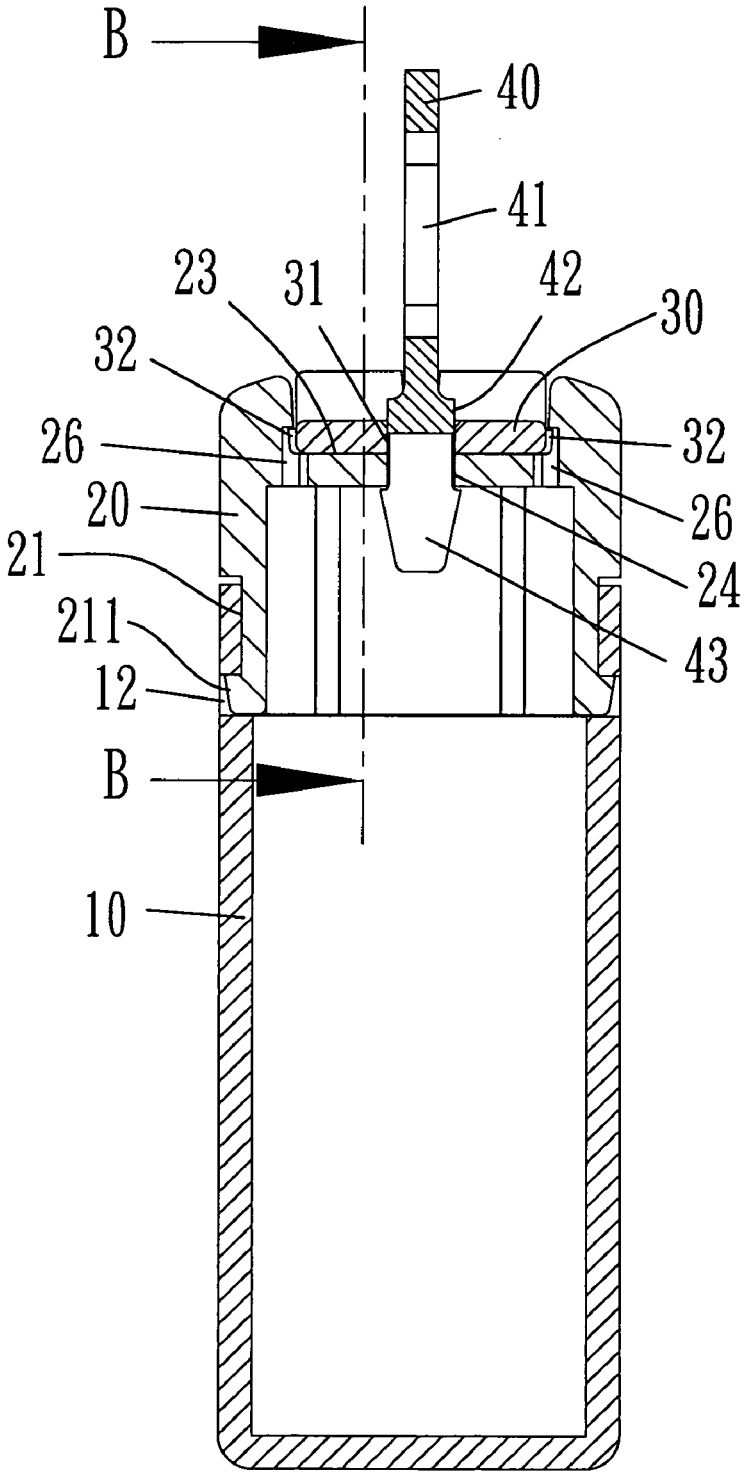
FIG. 8 is an A-A cross-sectional drawing according to FIG. 5.
Figure 10:
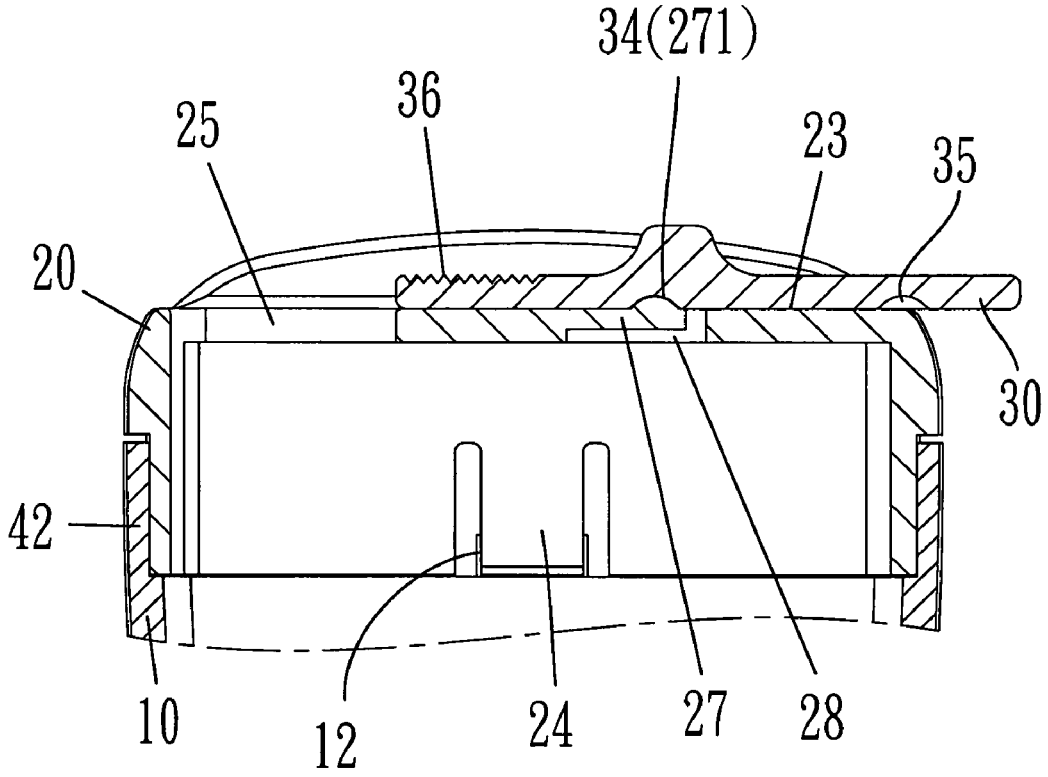
FIG. 10 is a schematic diagram of utilization status of a structure according to a preferred embodiment of the present invention.

The assembled padlock container structure is shown in FIG. 5, FIG. 7 and FIG. 10. While moving the sliding cover 30, the rod body 42 connected between the vertical via hole 31 of the sliding cover 30 and the central through hole 24 of the external cover 20 must be cut to allow the sliding cover 30 can freely shift and regulate.

As shown in FIG. 1, FIG. 5 and FIG. 7, after the rod body 42 of the hangtag 40 is strung in the vertical via hole 31 of the sliding cover 30 and the central through hole 24 of the external cover 20, the hangtag 40 in the embodiment is designed as a rectangular plate body to prevent the hangtag 40 from being randomly rotated. A protrusion portion 33 is disposed at a side of the vertical via hole 31 of the sliding cover 30. The protrusion portion 33 is a long strip, wherein its long edge direction is parallel with a short edge direction of the sliding cover 30, and the protrusion portion 33 is located at an area under the hangtag 40. The protrusion portion 33 has a slot 331 which is vertically disposed under the hangtag 40. Accordingly, a bottom of the hangtag 40 can be fit and limited in the slot 331 to prevent the hangtag 40 from being randomly rotated.

Figure 3:
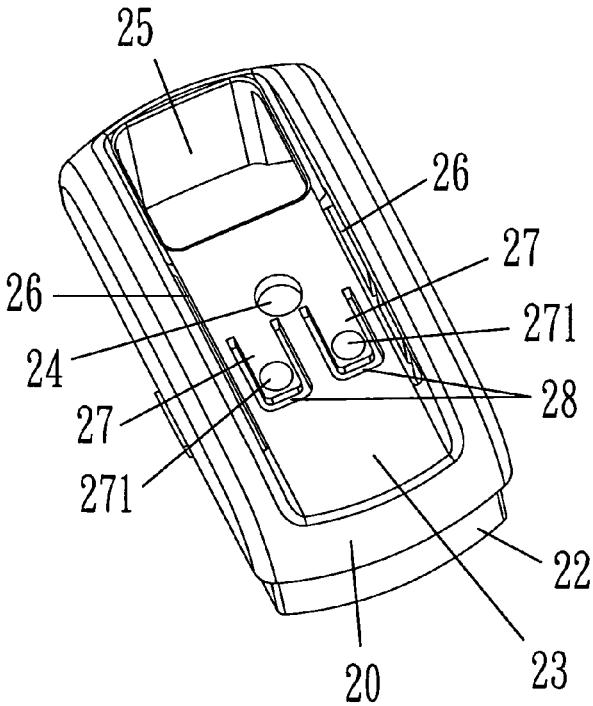
FIG. 3 is a top view drawing of an external case of a structure according to a preferred embodiment of the present invention.
Figure 4:
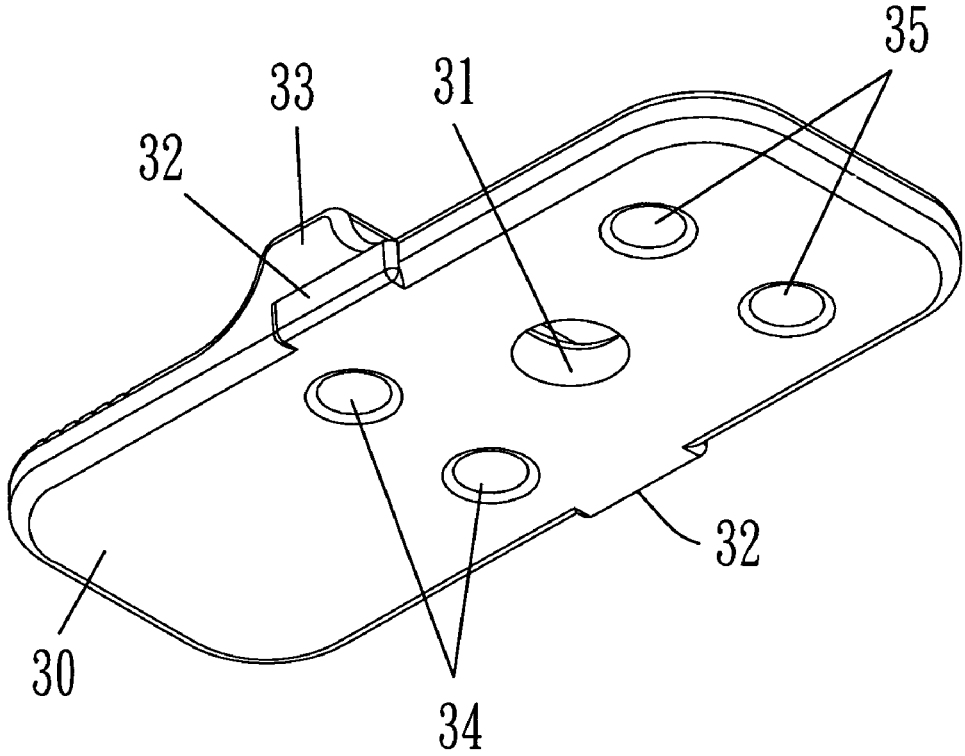
FIG. 4 is a bottom view drawing of a sliding cover of a structure according to a preferred embodiment of the present invention.

As shown in FIG. 1 and FIG. 3, at least one long elastic piece 27 is disposed on the platform 23 of the external cover 20. The long elastic piece 27 in the embodiment is integrated with the platform 23. A trench 28 piercing through the platform 23 is disposed along three ends of the long elastic piece 27. Only one short end of the long elastic piece 27 is connected to the platform 23. Accordingly, the long elastic piece 27 has functions of vertically moving and automatically restoring. Further, the long elastic piece 27 has a circular protrusion portion 271 near the short end of the trench 28. The circular protrusion portion 271 is disposed at an end of the long elastic piece 27. As shown in FIG. 4, the sliding cover 30 has more than one set of first circular cavities 34 and second circular cavities 35, which are properly spaced, at a side or two sides of the vertical via hole 31 to contain and limit the circular protrusion portion 271. In the preferred embodiment, the external cover 20 is provided with two long elastic pieces 27. The two long elastic pieces 27 are symmetrically disposed at a side of the central through hole 24 of the platform 23. Two sets of first circular cavities 34 and second circular cavities 35 are disposed at a bottom of the sliding cover 30.

Figure 9:
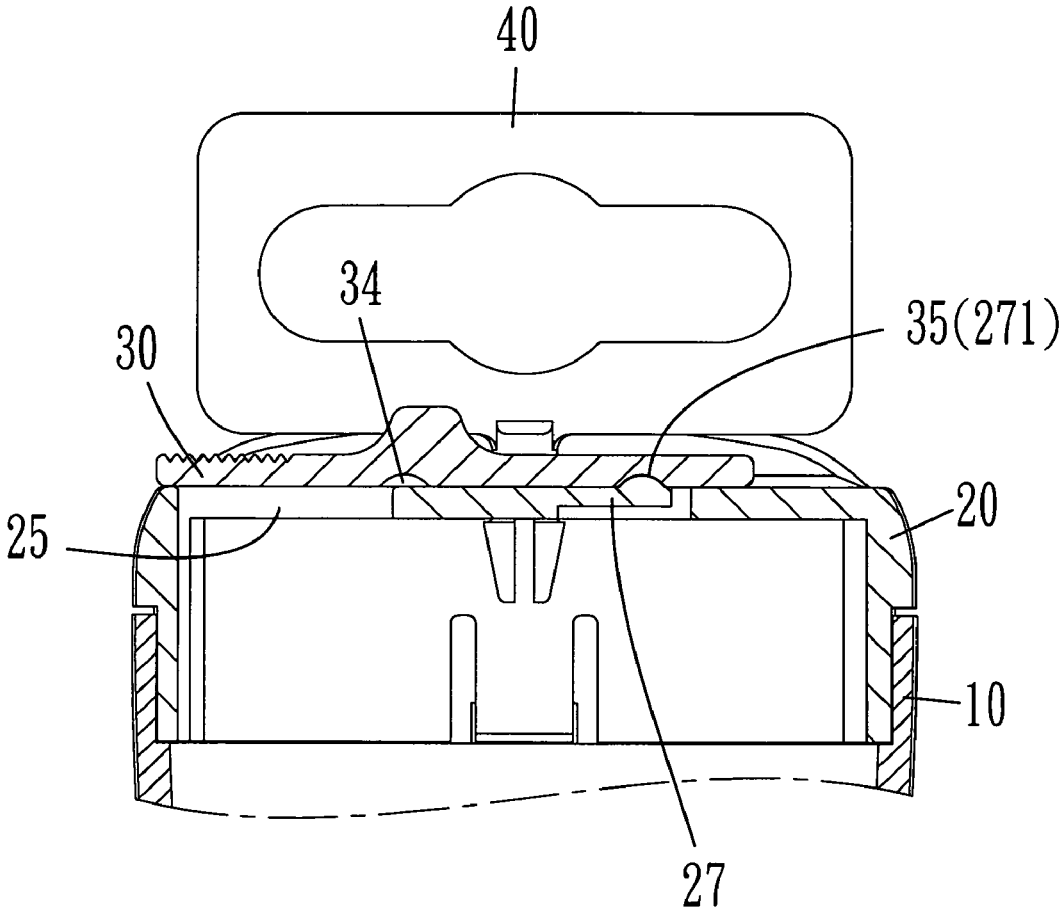
FIG. 9 is a B-B cross-sectional drawing according to FIG. 8.

As shown in FIG. 9 and FIG. 10, in the embodiment, when an end of the sliding cover 30 completely covers the shaped hole 25 of the external cover 20, the first circular cavities 34 disposed at an end of the sliding cover 30 can be fit the circular protrusion portions 271 corresponding to the long elastic pieces 27. After pushing the sliding cover 30 to allow one end to completely eject from the shaped hole 25 of the external cover 20, the second circular cavities 35 disposed at another end of the sliding cover 30 can be fit the circular protrusion portion 271 corresponding to the long elastic pieces 27.

Moreover, to prevent the sliding cover 30, which is pushed by a user, from being falling, a plurality of non-slip concave lines 36 is disposed to at least one side or two sides of the sliding cover 30 to improve the frictional coefficient when a hand is in contact with the sliding cover 30.

Although the features and advantages of the embodiments according to the preferred invention are disclosed, it is not limited to the embodiments described above, but encompasses any and all modifications and changes within the spirit and scope of the following claims.

What is claimed is:

1. A padlock container assembly comprising:
- a container box comprising:
  - a sidewall;
  - a closed bottom; and,
  - an open top;
- a closure comprising:
  - an external cover capable of being attached to the container box, the external cover having:
    - a central through hole defined by a front perimeter and a rear perimeter,
    - a shaped hole disposed at a side of the central through hole,
    - a first symmetric long sliding channel proximate the front perimeter, and
    - a second symmetric long sliding channel proximate the rear perimeter;
  - a sliding cover covering the platform, the sliding cover having:
    - a first end completely covering the shaped hole of the external cover,
    - a second end having a vertical hole aligned with the central through hole,
    - a first symmetric convex wing fitting in the first symmetric long sliding channel for shifting and regulating, and
    - a second symmetric convex wing fitting in the second symmetric long sliding channel for shifting and regulating; and
  - a hangtag having:
    - a hang hole disposed at an upper end,
    - a rod body disposed at a lower end passing through the vertical hole of the sliding cover and the central through hole of the external cover so as to lock the sliding cover and the external cover, and
    - symmetric flexible hangers disposed at an end of the rod body proximate to the central through hole.

2. The padlock container assembly as claimed in claim 1, wherein the sliding cover has a protrusion portion disposed at a side proximate the vertical hole, and the protrusion portion has a slot for fastening and containing a bottom of the hangtag.

3. The padlock container assembly as claimed in claim 1, wherein at least one long elastic piece is attached to the external cover, and the long elastic piece has a circular protrusion at an end, and more than one set of first circular cavities and second circular cavities corresponding to a quantity of the long elastic piece is disposed to a bottom of the sliding cover, and when one end of the sliding cover covers the shaped hole of the external cover, the circular protrusion portion is contained in one of the second circular cavities, and when the one end of the sliding cover ejects from the shaped hole of the external cover, the circular protrusion portion is contained in the one of the first circular cavities.

4. The padlock container assembly as claimed in claim 1, wherein a plurality of non-slip concave lines are disposed proximate at least one side of the sliding cover.

5. The padlock container assembly as claimed in claim 1, wherein the sidewall of the container box has symmetric buckle holes proximate the open top, and a bottom of the external cover having symmetric elastic pieces with respective convex stops connectable to the respective symmetric buckle holes of the container box to firmly secure the closure to the container box.

6. The padlock container assembly as claimed in claim 5, wherein a fitting section is downwardly extended from an external frame edge of the bottom of the external cover, and a size of an external frame of the fitting section is slightly smaller than a size of an external frame of the external cover, and the fitting section is completely contained inside the open top of the container box, and the symmetric elastic pieces are disposed upon a front surface of the fitting section and a rear surface of the fitting section.

* * * * *